US008158570B2

(12) United States Patent
Batchelor et al.

(10) Patent No.: US 8,158,570 B2
(45) Date of Patent: Apr. 17, 2012

(54) STAIN REMOVAL

(75) Inventors: Stephen Norman Batchelor, Wirral (GB); Matthew Tynan, Wirral (GB)

(73) Assignee: The Sun Products Corporation, Wilton, CT (US)

( * ) Notice: Subject to any disclaimer, the term of this patent is extended or adjusted under 35 U.S.C. 154(b) by 0 days.

(21) Appl. No.: 12/083,046

(22) PCT Filed: Sep. 26, 2006

(86) PCT No.: PCT/EP2006/009314

§ 371 (c)(1),
(2), (4) Date: Apr. 3, 2008

(87) PCT Pub. No.: WO2007/042140

PCT Pub. Date: Apr. 19, 2007

(65) Prior Publication Data

US 2009/0137442 A1 May 28, 2009

(30) Foreign Application Priority Data

Oct. 7, 2005 (GB) ..... 0520380.7

(51) Int. Cl.

| | |
|---|---|
| ***C11D 3/26*** | (2006.01) |
| ***C11D 3/28*** | (2006.01) |
| ***C11D 1/86*** | (2006.01) |
| ***C11D 3/386*** | (2006.01) |
| ***C11D 3/42*** | (2006.01) |

(52) U.S. Cl. ..... 510/276; 510/320; 510/324; 510/325; 510/351; 510/356; 510/394; 510/469; 510/499; 510/500

(58) Field of Classification Search ..... 510/276, 510/324, 325, 394, 469, 499, 320, 351, 356, 510/500

See application file for complete search history.

(56) References Cited

U.S. PATENT DOCUMENTS

| | | | | |
|---|---|---|---|---|
| 3,966,649 | A | 6/1976 | Cheng | 252/542 |
| 5,002,682 | A * | 3/1991 | Bragg et al. | 510/311 |
| 5,352,389 | A * | 10/1994 | Gazzani | 510/119 |
| 5,487,884 | A * | 1/1996 | Bissett et al. | 424/59 |
| 5,653,970 | A * | 8/1997 | Vermeer | 424/70.24 |
| 5,780,459 | A * | 7/1998 | Blank et al. | 514/159 |
| 7,521,408 | B2 * | 4/2009 | Vos et al. | 510/175 |
| 2002/0136700 | A1 * | 9/2002 | Margosiak et al. | 424/70.21 |
| 2007/0243132 | A1 * | 10/2007 | Russell-Jones et al. | 424/1.11 |
| 2007/0243222 | A1 * | 10/2007 | Lawyer et al. | 424/404 |
| 2008/0083435 | A1 * | 4/2008 | Myers et al. | 134/42 |
| 2008/0261842 | A1 * | 10/2008 | Hall et al. | 510/135 |

FOREIGN PATENT DOCUMENTS

| | | | |
|---|---|---|---|
| DE | 19546518 | A1 * | 6/1997 |
| EP | 0 490 417 | | 6/1992 |
| JP | 63 122796 | | 5/1988 |
| JP | 2 78611 | | 3/1990 |
| JP | 9 125100 | | 5/1997 |
| RU | 2 038 368 | | 6/1995 |
| WO | 00/34427 | | 6/2000 |
| WO | 02/51961 | | 4/2002 |
| WO | 2005/001016 | | 1/2005 |

OTHER PUBLICATIONS

Abstract of JP 63 122796 published May 26, 1988.
Abstract of JP 9 125100 published May 13, 1997.
Abstract of RU 2 038 368 published Jun. 27, 1995.
Abstract of JP 02 078611 published Mar. 19, 1990.

* cited by examiner

*Primary Examiner* — Lorna M Douyon

(57) ABSTRACT

The present invention provides a laundry detergent composition comprising an efficient sequestrant.

14 Claims, No Drawings

STAIN REMOVAL

FIELD OF INVENTION

The present invention concerns the use of particularly efficacious sequestrants for the removal of stains from fabrics.

BACKGROUND OF INVENTION

Tea and red wine are the source of many textile stains that are difficult to remove. There is a need for effective stain removal agents for laundry products that function at low temperature. Sequestrants can provide stain removal benefits at low temperatures, however many of these are not weight effective or contain phosphorous which is not desirable on environmental grounds.

SUMMARY OF THE INVENTION

Some of the non-phosphorous sequestrants used in the present invention have been disclosed in WO2002051961 and WO2005001016 as having utility in semiconductor cleaning solutions. We have found that the non-phosphorous sequestrants, primary sequestrant, are surprisingly weight and molar effective when compared to conventional sequestrants used in laundry applications. The non-phosphorous sequestrants have particular utility in removing stains from cotton textiles. The non-phosphorous sequestrants provide a better stain removal profile when used in combination with other sequestrants, particularity in combination with phosphorous based sequestrants.

In one aspect the present invention provides use of a composition, for cleaning a textile stain, in an aqueous medium, the composition comprising between 2 and 60 wt % of a surfactant and between 0.001 to 5 wt %, preferably 0.05 to 1 wt %, of a sequeterent, the non-phosphonate sequestrant having a molecular weight of less than 400 and of the following structure:

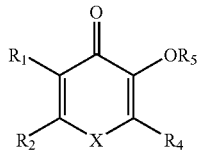

wherein X═N—R3;

$R_1$, $R_2$, and $R_4$ are independently selected from: a sulphonic acid group, an organic group and hydrogen; and, $R_3$ and $R_5$ are independently selected from: an organic group and hydrogen. The aforementioned composition preferably comprises a phosphonate sequestrant in the range 0.05 to 1 wt % and the present invention extends tpo such composition per se.

In another aspect the present invention provides use of the composition comprising the non-phosphonate sequestrant, wherein the use comprises the following steps:

(i) treating a stained textile in an aqueous medium, the aqueous medium comprising composition comprising: from 0.005 to 0.2 g/L of the non-phosphonate sequestrant, a surfactant at a level in the range from 0.1 g/L to 4 g/L, the aqueous medium having a pH in the range from 7 to 12;

(ii) rinsing the textile in an aqueous medium; and (iii) drying the textile.

The use of the composition is preferably conducted in the presense of a phosphonate sequestrant that is present in the aqueous medium in the range from 0.005 to 0.2 g/L.

DETAILED DESCRIPTION OF THE INVENTION

The pendant groups $R_1$ to $R_5$ may be optionally substituted without detracting from efficacy of the non-phosphonate sequestrant. In particular $R_1$ to $R_5$ may be optionally by amines or carboxylic acids, for example $R_3$═$CH_2C(NH_2)CO_2H$.

It is preferred that $R_5$ is selected from the group consisting of: H, a keto group, a C1 to C10-alkyl group, phenyl, and naphthyl. It is preferred that $R_1$, $R_2$ and $R_4$ are independently selected from: methyl, ethyl, propyl, butyl, phenyl, naphthyl, methoxy, ethoxy, hydrogen, sulphonic acid, carboxylic acid or salts thereof, ketone group, ester group and an acid amide group;

$R_3$ is independently selected from: methyl, ethyl, propyl, phenyl, naphthyl, and hydrogen.

Preferably $R_1$═$R_2$═$R_5$═H and $R_4$ is $CH_3$ or $C_2H_5$, $R_3$ is selected from the group consisting of selected from $CH_3$, $C_2H_5$, $C_3H_7$, and $C_2H_4COOM$, wherein M is H, an alkali metal or alkaline earth metal. It is most preferred that $R_3$ is preferably $CH_3$.

A preferred non-phosphonate sequesterent (X═N) is 3-hydroxy-1,2-dimethyl-4-pyridone.

Particularly good results may be obtained when the hereinbefore defined sequestrants, primary sequestrant, are used in conjunction with an additional sequestrants in the range 0.001 to 5 wt %, preferably 0.05 to 1 wt %, the additional sequestrant is other than the primary sequestrant. Phosphonate sequestrants are preferred as the additional sequestrant, particularly those sold under the Dequest® trade name (Thermphos USA Corp., Anniston, Ala.), most preferably Dequest® 2060-2069 deflocculant and sequestrant containing diethylenetriamine penta (methylene phosphonic acid) and/or salts thereof, Dequest® 2010-2019 deflocculant and sequestrant containing 1-hydroxyethylidene-1,1-diphosphonic acid and/or salts thereof, Dequest® 2040-2049 deflocculant and sequestrant containing ethylenediamine tetra(methylene phosphonic acid) and/or salts thereof.

Preferably the primary sequestrant is stored in an acidic granule in high pH powders. In this regard, the granule containing the primary sequestrant possesses a component selected from the group consisting of: a cogranulent, a binder and a coating, wherein the component is an acidic component.

Balance Carriers and Adjunct Ingredients

The composition in addition to the non-phosphonate sequestrant and surfactant comprises the balance carriers and adjunct ingredients to 100 wt % of the composition.

These may be, for example, builders, foam agents, shading dyes, anti-foam agents, solvents, fluorescers, bleaching agents, and enzymes. Preferably the composition comprises from 0.0001 to 0.1 wt % of a shading dye, from 0.01 to 1 wt % enzyme and from 0.1 to 1 wt % perfume. The use and amounts of these components are such that the composition performs depending upon economics, environmental factors and use of the composition.

The composition comprises a surfactant and optionally other conventional detergent ingredients. The composition may also comprise an enzymatic detergent composition which comprises from 0.1 to 50 wt %, based on the total detergent composition, of one or more surfactants. This surfactant system may in turn comprise 0 to 95 wt % of one or more anionic surfactants and 5 to 100 wt % of one or more nonionic surfactants. The surfactant system may additionally contain amphoteric or zwitterionic detergent compounds, but this in not normally desired owing to their relatively high cost. The enzymatic detergent composition according to the invention will generally be used as a dilution in water of about 0.05 to 2 wt %.

The composition comprises between 2 to 60 wt % of a surfactant, most preferably 10 to 30 wt %. In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$ to $C_{22}$ alkyl phenol-ethylene oxide condensates, generally 5 to 25 EO, i.e. 5 to 25 units of ethylene oxide per molecule, and the condensation products of aliphatic $C_8$ to $C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$ to $C_{18}$ alcohols, produced for example from tallow or coconut oil, sodium and potassium alkyl $C_9$ to $C_{20}$ benzene sulphonates, particularly sodium linear secondary alkyl $C_{10}$ to $C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$ to $C_{15}$ alkyl benzene sulphonates and sodium $C_{12}$ to $C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system that is a mixture of an alkali metal salt of a $C_{16}$ to $C_{18}$ primary alcohol sulphate together with a $C_{12}$ to $C_{15}$ primary alcohol 3 to 7 EO ethoxylate.

The nonionic detergent is preferably present in amounts greater than 10%, e.g. 25 to 90 wt % of the surfactant system. Anionic surfactants can be present for example in amounts in the range from about 5% to about 40 wt % of the surfactant system.

Cationic Compound

When the present invention is used as a fabric conditioner it needs to contain a cationic compound. The preferred pH when for a fabric conditioner is in the range from 3 to 5.

Most preferred are quaternary ammonium compounds.

It is advantageous if the quaternary ammonium compound is a quaternary ammonium compound having at least one $C_{12}$ to $C_{22}$ alkyl chain.

It is preferred if the quaternary ammonium compound has the following formula:

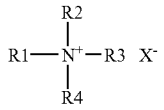

in which $R^1$ is a $C_{12}$ to $C_{22}$ alkyl or alkenyl chain; $R^2$, $R^3$ and $R^4$ are independently selected from $C_1$ to $C_4$ alkyl chains and $X^-$ is a compatible anion. A preferred compound of this type is the quaternary ammonium compound cetyl trimethyl quaternary ammonium bromide.

A second class of materials for use with the present invention are the quaternary ammonium of the above structure in which $R^1$ and $R^2$ are independently selected from $C_{12}$ to $C_{22}$ alkyl or alkenyl chain; $R^3$ and $R^4$ are independently selected from $C_1$ to $C_4$ alkyl chains and $X^-$ is a compatible anion.

A detergent composition according to claim 1 in which the ratio of (ii) cationic material to (iv) anionic surfactant is at least 2:1.

Other suitable quaternary ammonium compounds are disclosed in EP 0 239 910 (Proctor and Gamble).

It is preferred if the ratio of cationic to nonionic surfactant is from 1:100 to 50:50, more preferably 1:50 to 20:50.

The cationic compound may be present from 0.02 wt % to 20 wt % of the total weight of the composition.

Preferably the cationic compound may be present from 0.05 wt % to 15 wt %, a more preferred composition range is from 0.2 wt % to 5 wt %, and most preferably the composition range is from 0.4 wt % to 2.5 wt % of the total weight of the composition.

If the product is a liquid it is preferred if the level of cationic surfactant is from 0.05 wt % to 10 wt % of the total weight of the composition. Preferably the cationic compound may be present from 0.2 wt % to 5 wt %, and most preferably from 0.4 wt % to 2.5 wt % of the total weight of the composition.

If the product is a solid it is preferred if the level of cationic surfactant is 0.05 wt % to 15 wt % of the total weight of the composition. A more preferred composition range is from 0.2 wt % to 10 wt %, and the most preferred composition range is from 0.9 wt % to 3.0 wt % of the total weight of the composition.

Bleaching Species

The laundry treatment composition may comprise bleaching species. The bleaching species, for example, may selected from perborate and percarbonate. These peroxyl species may be further enhanced by the use of an activator, for example, TAED or SNOBS. Alternatively or in addition to, a transition metal catalyst may used with the peroxyl species. A transition metal catalyst may also be used in the absence of peroxyl species where the bleaching is termed to be via atmospheric oxygen, see, for example WO02/48301. Photobleaches, including singlet oxygen photobleaches, may be used with the laundry treatment composition. A preferred photobleach is vitamin K3.

Fluorescent Agent

The composition most preferably comprises a fluorescent agent (optical brightener). Fluorescent agents are well known and many such fluorescent agents are available commercially.

Usually, these fluorescent agents are supplied and used in the form of their alkali metal salts, for example, the sodium salts. The total amount of the fluorescent agent or agents used in laundry treatment composition is generally from 0.005 to 2 wt %, more preferably 0.01 to 0.1 wt %.

Preferred classes of fluorescer are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Blankophor SN. Preferred fluorescers are: sodium 2 (4-styryl-3-sulfophenyl)-2H-napthol[1,2-d]triazole, disodium 4,4'-bis{[(4-anilino-6-(N methyl-N-2 hydroxyethyl) amino 1,3,5-triazin-2-yl)]amino}stilbene-2-2'disulfonate, disodium 4,4'-bis{[(4-anilino-6-morpholino-1,3,5-triazin-2-yl)]amino} stilbene-2-2'disulfonate, and disodium 4,4'-bis(2-sulfoslyryl)biphenyl.

EXAMPLES

Example 1

Black tea beverage was created by placing 1 PG Tips pyramid tea bag in 400 ml of boiled ultrapure water for 5 minutes. The tea bag was then removed and the beverage allowed to cool to room temperature. Desized non-mercerised non-fluorescent white cotton sheeting was dipped in the cold tea and removed. The cloth was left to dry for 1 day in the dark, then used for experiments.

The tea stained cotton cloths were washed in pH 8.5 buffer containing 0.1 g/L of the compounds listed in the table below, for 30 minutes. Compounds were selected to provide a comparison of the pyridone compounds to current non-P containing sequesterants. The liquor to cloth ratio was 50:1. The cloth was removed rinsed and dried and the DeltaE values measured relative to a clean cloth. Whether the compound gave a benefit or a negative in terms of stain removal was quantified using the equation deltaE(benefit)=deltaE(control)−deltaE (compound) The 2 pyridones provided the highest benefit

| Compound | RMM | deltaE (benefit) |
|---|---|---|
| 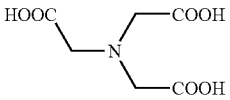 Nitrilo triacetate | 191 | 1.5 |
| 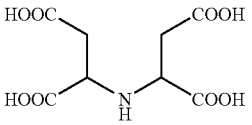 Imino Disuccinic acid | 249 | 0.0 |
| 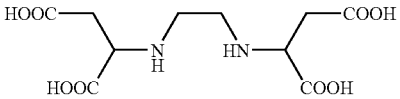 N,N'-Ethylenediaminedisuccinic acid | 292 | −0.1 |

-continued

| Compound | RMM | deltaE (benefit) |
|---|---|---|
| 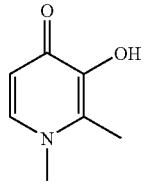 3-hydroxy-1,2-dimethyl-4-pyridone | 139 | 4.9 |
| 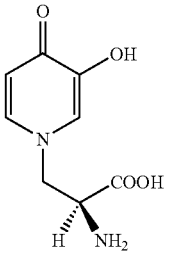 L-Mimosine | 198 | 2.8 |
| 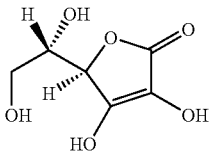 Ascorbic acid | 176 | 0.1 |

Example 2

Tea stained cloth was created as per example 1. The tea stained cloth was washed in the following commercial laundry products: Persil Performance (ex UK), OMO MA (ex Brasil) and Persil Liquid concentrate (ex UK). Persil Performance is a zeolite based product with anionic and non-ionic surfactants which contain the TAED/percarbonate bleaching system. OMO MA is a sodium tri-polyphosphate based product with anionic surfactant and does not contain bleach. Persil liquid concentrate contains surfactants, it does not contain bleach and operates at a lower pH than the powders. The washes were conducted at 30° C. for 30 minutes using 2.5 g/L product and a liquor to cloth ration of 35:1. All cloth was stained. Following the wash the clothes were rinsed, dried and the clothes measured using a reflectometer and the staining of the cloth expressed as deltaE relative to unwashed clean white cloth. Experiments were repeated with addition of varying levels of 3-hydroxy-1,2-dimethyl-4-pyridone (CAS No 30652-11-0).

The deltaE results are shown in the table below:

| | [3-hydroxy-1,2-dimethyl-4-pyridone] in g/L | | | |
|---|---|---|---|---|
| Product | 0 | 0.01 | 0.05 | 0.1 |
| Persil Performance | 15.8 | 14.5 | 13.6 | 11.8 |
| OMO MA | 16.4 | 15.2 | 13.6 | 12.9 |

-continued

| Product | [3-hydroxy-1,2-dimethyl-4-pyridone] in g/L | | | |
|---|---|---|---|---|
| | 0 | 0.01 | 0.05 | 0.1 |
| Persil Liquid | 17.9 | 16.3 | 13.4 | 12.7 |

Addition of 3-hydroxy-1,2-dimethyl-4-pyridone increases the tea stain removal seen with all products, as shown by a decrease in the deltaE value.

Example 4

3-hydroxy-1,2-dimethyl-4-pyridone increased the stain removal of the tea and wine stains when washed in pH buffer solution at 8.5 and 10.

Example 5

Tea stains were created as per example 1. Red wine stains were created in an analogous manner, except here the cloth was dipped into red wine (Australian, Shiraz Cabinet 2003). The stains were washed at 30° C. for 30 minutes using 4 g/L of ECE reference detergent with a liquor to cloth ratio of 50:1. 6° FH (Ca:Mg 2:1) water was used in the experiment. After washing, rinsing and drying the colour of the cloth was measured and expressed as the DeltaE relative to clean white cloth. The experiment was then repeated with the addition of 0.05 g/L of the sequesterants listed below.

ECE reference detergents contains 0.80% of the phosphorous based sequesterant Dequest 2066. Dequest 2016 and Dequest 2060 are also phosphorous based sequestrant. Dequest 2060 and 2066 are analagous except 2060 is the phosphonic acid, and 2066 is Na salt.

| Wash system | deltaE tea stain | deltaE red wine stain |
|---|---|---|
| ECE | 10.6 | 11.3 |
| ECE + 3-hydroxy-1,2-dimethyl-4-pyridone | 8.5 | 8.7 |
| ECE + Dequest 2016 | 10.4 | 10.4 |
| ECE + Dequest 2060 | 10.4 | 10.8 |
| ECE + Na Ascorbate | 10.5 | 11.0 |

From the results 3-hydroxy-1,2-dimethyl-4-pyridone increases the stain removal by the largest amount. For example for tea and additional stain removal of 2.1 units is observed compared to a maximum of 0.2 units for the other sequestrants.

We claim:

1. A laundry detergent composition comprising a cationic compound, between 2 and 60 wt % of a surfactant system, between 0.005 and 2 wt % of a fluorescent agent, from 0.01 to 1 wt % of enzyme, and between 0.05 and 1 wt % of a first non-phosphonate sequestrant, the non-phosphonate sequestrant having a molecular weight of less than 400 and having the following structure:

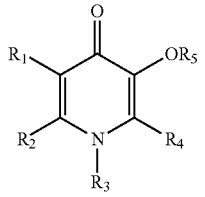

wherein $R_1$, $R_2$, and $R_4$ are independently selected from the group consisting of methyl, ethyl, propyl, butyl, phenyl, naphthyl, methoxy, ethoxy, hydrogen, sulphonic acid, carboxylic acid or salts thereof, a ketone group, an ester group, and an acid amide group;

$R_3$ is selected from the group consisting of hydrogen, methyl, ethyl, propyl, phenyl, naphthyl, and $C_2H_4COOM$, wherein M is hydrogen, an alkali metal or alkaline earth metal; and $R_5$ is selected from the group consisting of hydrogen, a keto group, a $C_1$-$C_{10}$ alkyl group, phenyl, and naphthyl, wherein said surfactant system comprises a mixture of anionic and nonionic detergent compounds, wherein the nonionic detergent compounds are selected from the group consisting of $C_6$ to $C_{22}$ alkyl phenol-ethylene oxide condensates having 5 to 25 units of ethylene oxide per molecule; condensation products of aliphatic $C_8$ to $C_{18}$ primary or secondary linear or branched alcohols with ethylene oxide having 5 to 40 units of ethylene oxide per molecule; and wherein the anionic detergent compounds are water-soluble alkali metal salts of organic sulphates or sulphonates having alkyl radicals containing from 8 to 22 carbon atoms, wherein said composition is an enzymatic laundry detergent composition, and wherein the ratio of cationic compound to anionic surfactant is at least 2:1.

2. The composition according to claim 1, wherein $R_3$ is $CH_3$ or $C_2H_5$.

3. The composition according to claim 1, wherein $R_1$=$R_2$=$R_5$=H, $R_4$ is $CH_3$ or $C_2H_5$, and $R_3$ is selected from the group consisting of $CH_3$, $C_2H_5$, $C_3H_7$, and $C_2H_4COOM$, wherein M is H, an alkali metal or alkaline earth metal.

4. The composition according to claim 1, wherein the non-phosphonate sequestrant is 3-hydroxy-1,2-dimethyl-4-pyridone.

5. The composition according to claim 1, wherein the composition further comprises a second sequestrant in the range of 0.001 to 5 wt %, wherein the second sequestrant is different from the first sequestrant.

6. The composition according to claim 5, wherein the second sequestrant is a phosphonate sequestrant.

7. The composition according to claim 6, wherein the second sequestrant is a composition containing diethylenetriamine penta (methylene phosphonic acid) and/or salts thereof; 1-hydroxyethylidene-1,1-diphosphonic acid and/or salts thereof; or ethylenediamine tetra(methylene phosphonic acid) and/or salts thereof.

8. The composition according to claim 1, wherein said anionic detergent compounds are sodium or potassium alkyl sulphates, having alkyl radicals containing from 8 to 18 carbon atoms.

9. The composition according to claim 1, wherein said anionic detergent compounds are sodium or potassium benzene sulphonates, having alkyl radicals containing from 9 to 20 carbon atoms.

10. The composition according to claim 1, wherein said anionic detergent compounds are sodium alkyl glyceryl ether sulphates.

11. The composition according to claim 8, wherein said anionic detergent compounds are sodium alkyl sulphates, having alkyl radicals containing from 12 to 18 carbon atoms.

12. The composition according to claim 9, wherein said anionic detergent compounds are sodium benzene sulphonates, having alkyl radicals containing from 11 to 15 carbon atoms.

13. The composition according to claim 1, wherein the surfactant system comprises greater than 10 wt % of nonionic detergent.

14. The composition according to claim 1, wherein the surfactant system comprises from about 5% to about 40 wt % of anionic surfactant.

* * * * *